US009327151B2

(12) United States Patent
Hansen

(10) Patent No.: US 9,327,151 B2
(45) Date of Patent: May 3, 2016

(54) FIRE-FIGHTING EXTINGUISHER NOZZLE; A METHOD FOR FABRICATING SUCH NOZZLE, AND A METHOD FOR PRODUCING A SPRAY OF FINE-DROPLET MIST

(75) Inventor: Bjørn R. Hansen, Lillehammer (NO)

(73) Assignee: PREVENT SYSTEMS AS, Lillehammer (NO)

( * ) Notice: Subject to any disclaimer, the term of this patent is extended or adjusted under 35 U.S.C. 154(b) by 65 days.

(21) Appl. No.: 14/111,346

(22) PCT Filed: Apr. 11, 2012

(86) PCT No.: PCT/NO2012/050061

§ 371 (c)(1), (2), (4) Date: Dec. 12, 2013

(87) PCT Pub. No.: WO2012/141595

PCT Pub. Date: Oct. 18, 2012

(65) Prior Publication Data

US 2014/0090858 A1 Apr. 3, 2014

(30) Foreign Application Priority Data

Apr. 12, 2011 (NO) ..... 20110555

(51) Int. Cl.
*A62C 31/05* (2006.01)
*B05B 1/14* (2006.01)
(Continued)

(52) U.S. Cl.
CPC ..... *A62C 31/05* (2013.01); *A62C 99/0072* (2013.01); *B05B 1/14* (2013.01); *B05B 1/26* (2013.01); *B05B 1/267* (2013.01); *Y10T 29/49995* (2015.01)

(58) Field of Classification Search
CPC ..... A62C 31/05; A62C 31/02; A62C 37/08; A62C 99/0072; A62C 37/11; A62C 37/14; B05B 1/14; B05B 1/26; B05B 1/042; B05B 1/046; B05B 1/04; B05B 1/02; B05B 1/0267
USPC ..... 169/37–39, 40, 41, 56–58; 239/558, 239/601
See application file for complete search history.

(56) References Cited

U.S. PATENT DOCUMENTS 2,235,258 A 3/1941 Jones
2,499,092 A * 2/1950 Burnam ..... 239/544
(Continued)

FOREIGN PATENT DOCUMENTS

DE 200 04 206 7/2000
EP 0 671 216 A2 9/1995
(Continued)

OTHER PUBLICATIONS

International Search Report dated Jul. 16, 2012 issued in connection with PCT/NO2012/050061.

*Primary Examiner* — Len Tran
*Assistant Examiner* — Cody Lieuwen
(74) *Attorney, Agent, or Firm* — Foley & Lardner LLP

(57) ABSTRACT

Method and a fire-fighting extinguisher nozzle for providing a spray of fine droplet mist of liquid into a space, room or a cavity, comprises a number of openings in the exterior surface of the nozzle. Openings communicate with a liquid source through at least one small diameter drilled hole in a nozzle material, enabling liquid in the form of a mist to be directed at least partly in lateral direction and/or at least partly in a sector axially out from the nozzle. The nozzle is also being associated with trigger mechanism, initiating the mist creating effect by allowing an extinguishing liquid to be sprayed out the openings of the nozzle when heat or fumes are detected. Some of the drilled holes are configured in such way that a deflecting surface is provided inside the drilled holed in the nozzle material in the vicinity of the outlet, causing formation of the mist spray of crushed liquid consisting of fine, minute droplets just inside the drilled holes.

8 Claims, 4 Drawing Sheets

(51) Int. Cl.
*B05B 1/26* (2006.01)
*A62C 99/00* (2010.01)

(56) References Cited

U.S. PATENT DOCUMENTS

| | | | | |
|---|---|---|---|---|
| 6,230,815 | B1 * | 5/2001 | Sundholm | 169/37 |
| 6,318,474 | B1 * | 11/2001 | Sundholm | 169/37 |
| 2008/0083838 | A1 * | 4/2008 | Waddelow | 239/104 |
| 2010/0025051 | A1 * | 2/2010 | Kristensen | 169/37 |
| 2010/0181083 | A1 | 7/2010 | Kikkawa et al. | |
| 2010/0191083 | A1 | 7/2010 | Parker et al. | |
| 2010/0326677 | A1 * | 12/2010 | Jepsen et al. | 169/37 |

FOREIGN PATENT DOCUMENTS

| | | | | | |
|---|---|---|---|---|---|
| EP | 0 972 574 | A1 | | 1/2000 | |
| FR | 571686 | | | 5/1924 | |
| GB | 633862 | | * | 3/1947 | A62C 31/02 |
| GB | 0 633 862 | A | | 12/1949 | |
| GB | 1 178 631 | | | 1/1970 | |
| WO | WO-2006/104418 | A2 | | 10/2006 | |
| WO | WO-2012/031595 | A2 | | 3/2012 | |

* cited by examiner

FIRE-FIGHTING EXTINGUISHER NOZZLE; A METHOD FOR FABRICATING SUCH NOZZLE, AND A METHOD FOR PRODUCING A SPRAY OF FINE-DROPLET MIST

CROSS REFERENCE TO RELATED APPLICATIONS

The present application is a National Stage of International Application No. PCT/NO2012/050061 filed on Apr. 11, 2012, which claims the benefit of Norwegian Patent Application No. 20110555 filed on Apr. 12, 2011. The entire disclosures of which are incorporated herein by reference.

THE TECHNICAL FIELD OF THE INVENTION

The present invention relates to a nozzle for providing a spray mist of water or liquid into a space, room or a cavity to function as a fire-fighting extinguisher. More specifically, but not exclusively, the present invention relates method and a nozzle for fire-fighting for providing a spray of crushed, vaporized liquid into a space, room or a cavity. The nozzle comprises a number of openings in the exterior surface of the nozzle, the openings communicating with a liquid source through one or more small diameter drilled holes in a nozzle material, enabling liquid to be directed at least partly in lateral direction and/or at least partly in a sector axially out from the nozzle and preferably also in a more or less axial direction, the nozzle also being associated with trigger mechanism, initiating the liquid mist effect by allowing an extinguishing liquid to flow through the system when heat or fumes are detected.

The invention relates also to a method for fabricating a nozzle intended to produce a spray of vaporized liquid into a space, room or a cavity by providing at least one, preferably a number of holes in the exterior surface of the nozzle, the holes communicating with a liquid source through at least one small diameter drilled hole in the nozzle material, enabling liquid to be directed at least partly in laterally sectored direction and/or at least partly in a sector axially out from the nozzle.

BACKGROUND OF THE INVENTION

On installations, for example offshore and/or in buildings where a fire may occur, it is common practice to incorporate or install a fire-extinguishing system, the fire extinguishing fluid often being water delivered through nozzles installed in the space or the rooms to be protected. The extinguishing liquid may be delivered at a pressure from a liquid source through a piping system.

Typical areas of use are installation in buildings, such as for example hotels, offices, houses, or the like or in process plants either onshore or offshore. Another typical installation where the fire-fighting extinguishing system of this type may be installed, may be very old buildings of historical interest or onboard vessels of any type.

US 2011/0061879 describes an extinguishing nozzle body for spraying extinguishing fluid into a room. The extinguishing nozzle body is provided with at least two spray nozzles arranged along the periphery of the extinguishing nozzle body and at least one deflector arranged in the area of spray jet of the extinguishing fluid emerging from the spray nozzle. Effective fire-fighting is achieved in that a spray angle of the spray jet relative to the lateral surface of the extinguishing nozzle body, an angle of attack of the deflector relative to the direction of the spray jet, a clearance between the deflector and the lateral surface of the extinguishing nozzle body and a high pressure of the extinguishing fluid is set in such way that a cone-shaped spray pattern ensues.

SUMMARY OF THE INVENTION

A main principle used according to the invention is to create the mist in a region of the nozzle where the extinguishing fluid still is subjected to a higher pressure than the atmospheric pressure of the surrounding environment. As a consequence the mist is produced inside the nozzle or in the region just upstream of the openings of the nozzle where the extinguishing fluid still is subjected to the pressure inside the fire extinguisher system.

Hence, an object of the invention is to utilize the pressure energy of the extinguishing system to produce the mist.

Another object of the invention is to provide an improved low-pressure fine droplet water mist nozzle, i.e. a nozzle working at a liquid pressure in the region 2.5 to 12 bar.

A further object of the invention is to provide a nozzle suitable to be installed on a vertical wall, and still covering all relevant surfaces in a room, also including the wall on which the nozzle(s) are mounted.

A still further object of the invention is to provide a nozzle assembly having an esthetic appearance, without to any substantial degree, projecting out from the surface on which it is installed.

Another object of the present invention is to provide a more simplified, more efficient and cost effective way of producing an enhanced nozzle for fire-fighting extinguishing, providing the required fine droplet mist, able to cover all relevant surfaces in a room or a cavity.

A still further object of the present invention is to provide a nozzle able to work with low pressure liquid and still being able to efficiently produce a fine mist with optimal coverage of all possible surfaces to be protected.

Another object is to provide a nozzle which, when in installed state, may more or less be flush with the surface, such as a wall or a ceiling, on which it is mounted, thus not extending to any degree out from the surface.

Another object of the present invention is to fabricate a nozzle assembly where the nozzle house, including the holes and apertures, but excluding possible release mechanisms, may be made of one single work piece, such fabrication being suited for a robot machine.

Another object of the invention, is to provide an enhanced method for producing a small particle mist of a combined mixture of small, minute and somewhat larger droplets, the mist being sprayed in such way that the mist is able to cover the entire space to be covered.

Another object of the present invention is to provide an improved method for fabricating such nozzle assembly, requiring a limited number of parts to be assembled.

The objects are achieved by means of a nozzle and method of use and a method for fabrication as further defined by the independent claims herein, while alternatives and detailed embodiments are defined by the dependent claims.

According to one embodiment of the present invention it is provided a fire-fighting extinguisher nozzle configured to direct a produced spray of a liquid mist into a space, room or a cavity. The nozzle comprises a number of apertures or openings in the exterior surface of the nozzle. The openings or apertures communicate with a liquid source through small diameter drilled holes in a nozzle material, enabling liquid in the form of a mist to be directed at least partly in lateral direction and/or at least partly in a sector axially out from the nozzle. The nozzle may also be associated with a trigger mechanism, initiating the crushing effect of a liquid by allowing a liquid to be sprayed out through the openings of the nozzle when heat or fumes are detected. At least some of the drilled holes are configured in such way that a deflecting surface and crushing zone are provided inside the drilled holes in the nozzle material in the vicinity of the outlet, intended to produce the mist spray of fine particle or droplet liquid mist just inside the drilled holes.

The deflecting surfaces may preferably be arranged immediately upstream the outlet of the drilled holes, the deflecting surfaces being formed by the tip of the drill bit, providing an internally arranged, slanted surface just inside the drilled hole at its opening or aperture.

The aperture of at least some of these openings of the drilled holes in the nozzle may be different in size, have different inclined or slanted surface(s) and/or orientation, the lateral extent of the slanted surface being decisive for the size of the exposed aperture area of the opening.

According to one embodiment, the slanted surfaces may be configured in such way that the apertures are displaced sideways away from the center of the drilled hole, facing away from the main center of the nozzle body, allowing the spray of the mist to be directed more or less sideways away from the nozzle.

The nozzle indicated above may also be provided with radially oriented holes, drilled in the radial plane, allowing laterally orientation of the spray, so as to provide spraying in all directions.

According to one embodiment, for example every second drilled hole may be drilled as far out towards the periphery of the nozzle body as possible, while other drilled holes may be arranged with a center line placed closer to the center line of the nozzle body, thus providing apertures with different radial positions and/or exposed cross section areas.

Further, the inner end of the hole is provided with a cone shape, the angle of inclination between the coned end surfaces either being oblique or acute, dependent upon the required inclination of the slanted surface and/or the size of the aperture, in order to vary the size of the aperture and the direction of the emitted spray of small and fine droplet mist.

According to the present invention also a method for producing a spray of liquid crushed into a mist of fine, small droplets is provided, enabling a fine-droplet mist to be sprayed into a space, room or a cavity. The mist is produced by allowing a liquid at a low pressure, for example in the region of 2.5-12 bar, to flow out through a number of apertures or openings in the exterior surface of the nozzle. The apertures or the openings communicate with a liquid source through small diameter drilled holes in the nozzle material, producing a mist and enabling the mist to be directed at least partly in lateral direction and/or possibly at least partly in a sector axially out from the nozzle. The nozzle also provided with trigger mechanism, initiating the crushing effect when heat or fumes are detected, the trigger mechanism initiating the flow of extinguishing liquid through the opening(s) of the nozzle. According to the present invention, at least a part of the liquid flowing through the small diameter drilled holes is allowed to hit a slanted surface provided inside the holes, displaced laterally with respect to the aperture. Further, at least another part of the liquid flowing through the drilled holes is allowed to be impacted by the deflected liquid, such impact causing formation of the mist spray in the aperture region of the drilled holes, the impact being caused in a part of the nozzle where the impact still is subjected to the pressure inside the fire-extinguisher system, prior to being subjected to the atmospheric pressure in the surrounding environment and prior to the stage where the pressure energy of the fluid is converted to kinetic energy.

The invention also comprises a method for fabricating such nozzle, intended to produce a spray of liquid crushed into the form of mist, the fabrication starting with a solid, massive rod shaped metal work piece having cylindrical walls, open at one end and closed at the other end by a closed metal bottom. At least one axially aligned small diameter hole is drilled into the metal bottom of the work piece to a certain depth, avoiding penetration through the bottom, starting from inner side of the tube. Upon completed drilling of hole(s), the material at the opposite, external side of the metal bottom of the work piece is partly lathed or machined away, so that just a part of the tip of the drilled hole is exposed, leaving an internally arranged slanted or sloped surface inside the drilled hole, sloping down towards the exposed aperture at the end of the drilled small diameter holes.

According to one preferred embodiment of the invention, several axially aligned small diameter holes are drilled in the end wall of the nozzle body, the holes being drilled to different depths and/or arranged at different radial position with respect to the center line of the nozzle body, and/or having different diameter and/or different inner end slope, caused by drills bits with a different cone at the drill tip, thereby providing for different aperture sizes, different deflection surfaces and areas and/or spraying direction of the exposed apertures in the nozzle surface.

The nozzle according to the present invention is suitable for working at a low pressure, for example in the region of 2.5-12 bars, i.e. low pressure extinguishers. It should be noted, however, that the nozzle 10 also may operate at even lower pressure down to a range between 0.5-4 bar. By choosing the right size of the bore and appropriate machining, such nozzle may function as a residential sprinkler, producing somewhat larger droplets and thus requiring a larger consume of water.

One major advantage of the invention is that the fluid pressure of the system is used to produce the required mist, such mist production being caused prior to the fluid having left the apertures of the nozzle and prior to the liquid being subjected to the atmospheric pressure of the room into which the fluid is directed. Hence, the mist is produced at a stage prior to the energy of the fluid being converted to kinetic energy Another advantage with the solution according to the present invention resides in that the nozzle, apart from the internally arranged valve and the release mechanism, may be machined from one work piece only, applying drilling of straight holes together with lathing and/or milling the external end surface of the work piece, thus providing the slanted surfaces inside the drilled holes.

SHORT DESCRIPTION OF THE DRAWINGS

In the following, embodiments of the invention will be described in further details by way of examples; wherein:

FIGS. 1*a* and 1*b* show a section through one embodiment of the present invention, also indicating a release mechanism; a valve; and valve seat, where FIG. 1*a* shows the nozzle in position prior to release of the sealing valve, while FIG. 1*b* shows the nozzle subsequent to said release;

Figure 8:
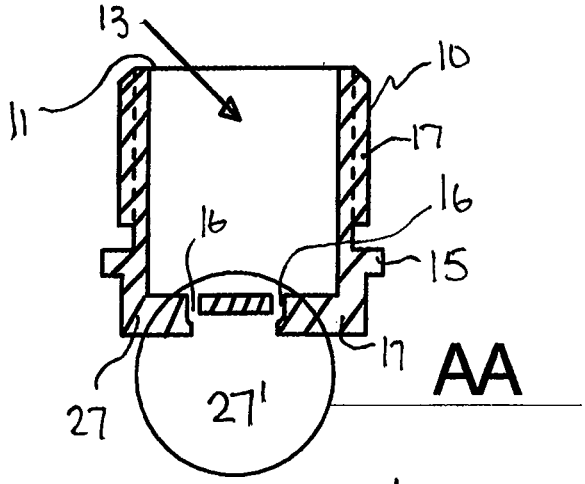
FIG. 8 shows a section through the nozzle shown in FIG. 7, seen along the line D-D in FIG. 7.
Figure 9:
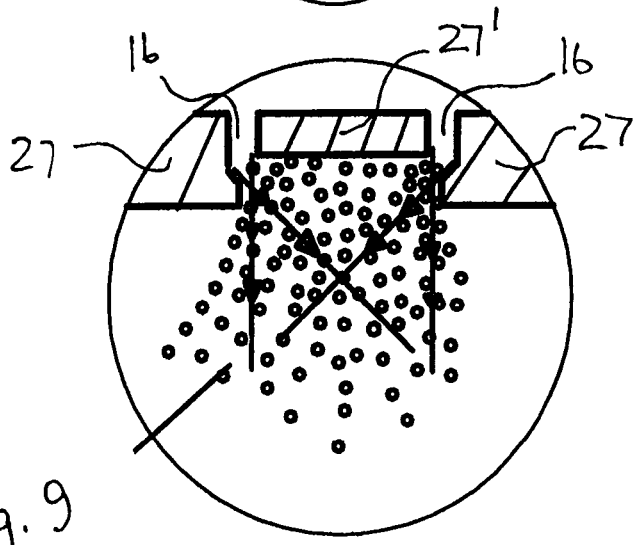
Figure 10A:
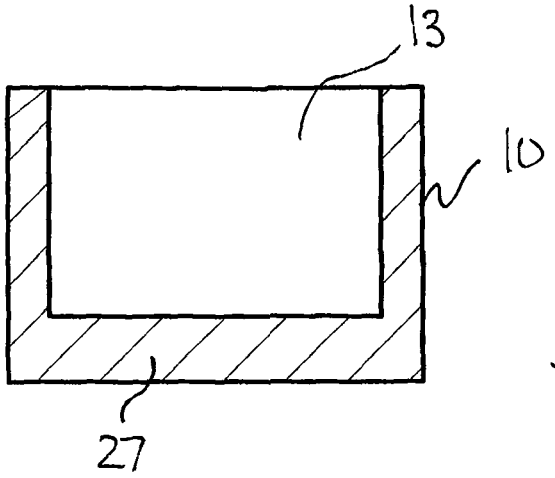
Figure 10B:
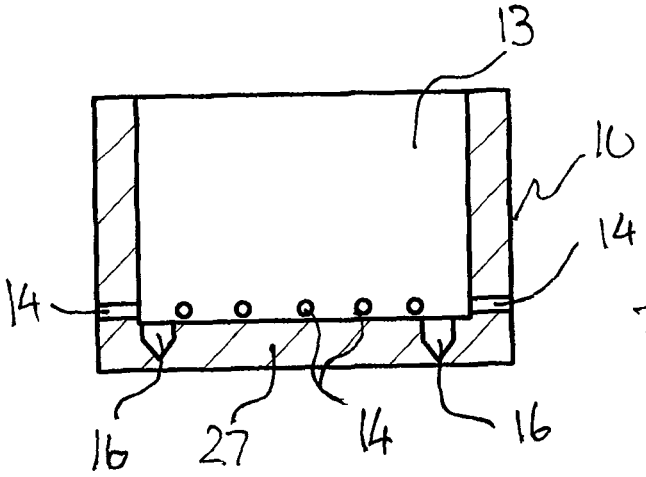
Figure 10C:
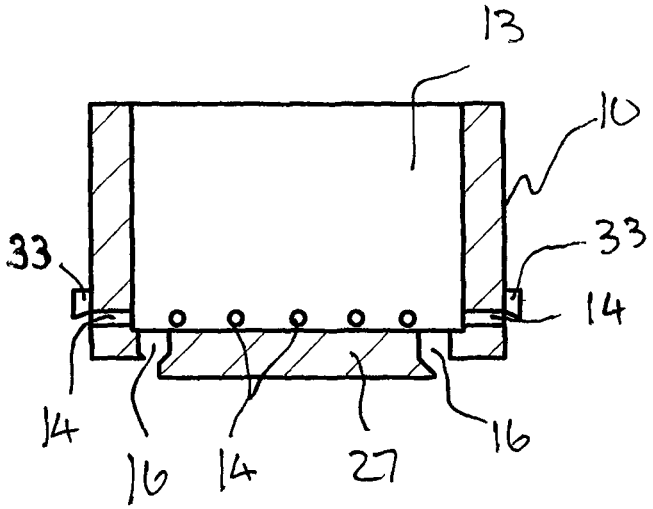

FIG. 9 shows in enlarged scale details of the openings indicated by the circle AA in FIG. 8; and FIGS. 10*a*-10*c* show three stages in machining a work piece for producing a nozzle according to the present invention, where FIG. 10*a* shows the initial stage where a central hole is drilled out in the work piece, forming a cylindrical body having for example a circular cross sectional shape and a bottom end plate; FIG. 10*b* shows the stage where radial holes are drilled and where two axial holes also are drilled; and FIG. 10*c* shows the final stage where part of the material at the peripheral end on the external side of the bottom is machined out, producing the end shape of the drilled holes with a slanted or inclined surface pointing laterally out from the centerline of the cylindrical body.

DETAILED DESCRIPTION OF INVENTION

In the following description, the same reference numbers are used throughout the description for the same or similar features and elements. Further, it should be noted that the same principle for crushing the liquid flowing through the holes 16 is used, creating liquid jets impacting each other under a pressure between 0.5 bar and 12 bars, preferably between 2.5 bar and 12 bar, thus causing a mist which preferably may consist of a mixture of a large number of very small, minute droplets and droplets of somewhat larger diameter, thus creating an effective fire-fighting extinguishing mist which may travel trough the room in all required directions.

It should also be noted that the liquid used preferably, but not necessarily, may be water.

Figure 1B:
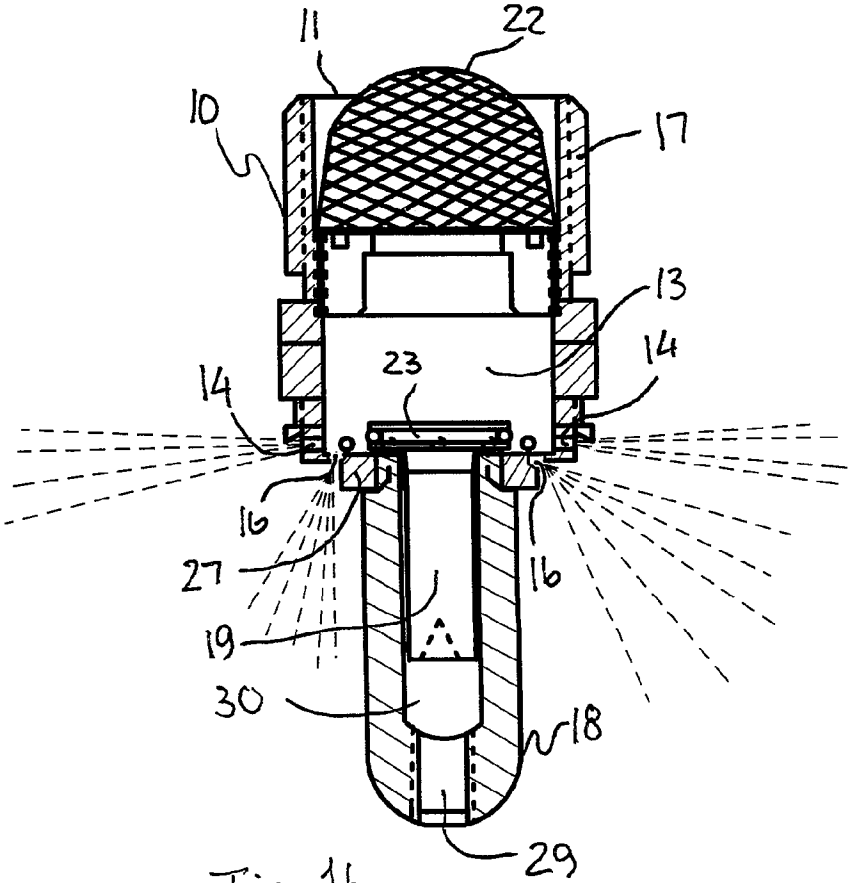
Figure 1A:
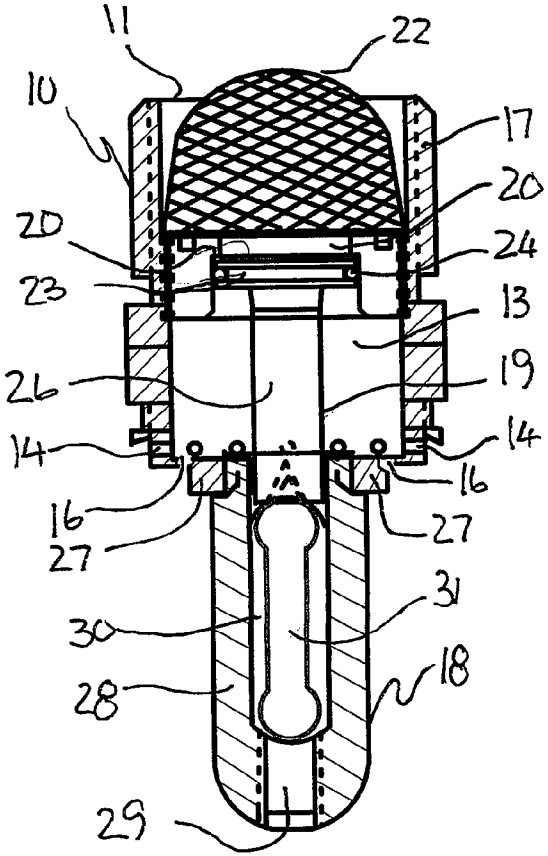

FIGS. 1*a* and 1*b* show a section through one embodiment of the nozzle 10 according to the present invention, also indicating a release mechanism 31 and a valve 19 and valve seat 20, where FIG. 1*a* shows the nozzle 10 in position prior to release of the valve 19, while FIG. 1*b* shows the nozzle 10 subsequent to said release. FIGS. 1*a* and 1*b* shows a section an assembled nozzle 10, also indicating a release mechanism 18 and a closing/opening valve 19 and valve seat 20 inside the nozzle body 10. The nozzle 10 has a cylindrical shape with a circular cross section area. The nozzle 10 is provided with a threaded sleeve 11, intended to be screwed or coupled to a supply pipe (not shown), communicating with a fluid reservoir (not shown). The means for coupling to the supply pipe is of a type well known to the person skilled in the art and will not be further described herein. In order to enhance correct and proper fitting of the nozzle 10 to the supply line, the nozzle 10 is provided with a hexagonally shaped flange 15 (see FIG. 4), allowing the plumber to screw the nozzle on to the fittings (not shown) at the end of the supply line, applying conventional torque and wrench tools. The nozzle 10 is provided with a number of small radially arranged diameter holes 14, communicating fluidly with a large diameter hole 13, centrally arranged in the nozzle body 10. Further, the nozzle 10 is also provided with holes 16 extending more or less in axial direction of the nozzle 10.

Since the holes 14,16 and their apertures are small diameter holes, the nozzle 10 is provided with an internally arranged fine masked strainer 22, arranged upstream the holes 14,16, preventing particles, such as sand or the like, from blocking the holes 14,16 or their apertures.

The nozzle 10 is also provided with an internally arranged valve 19, comprising a valve body 23 with a first upper and second lower sealing surface, the valve body 23 being fixed to a valve stem 26, the valve body 23 also being provided with a sealing O-ring 24, resting against a valve seat, fixed internally in the large diameter hole 13. At the other side of the valve body 23, a second sealing surface is formed, intended to rest in a sealing manner against a sealing seat 27 on the nozzle body 10 when the trigger rod 31 is broken, said sealing surface and sealing seat 27 preventing water to flow out through the central hole 29 of the trigger pin containing housing 28, forcing all the liquid to flow out through the holes 14,16.

The releasing mechanism 18 comprises a threaded portion configured to be screwed into a corresponding threaded hole in the surface 27 of the nozzle. The releasing mechanism comprises a trigger rod 31 containing housing 28 projecting outwards from the valve 10, the housing 28 being provided with an axially extending drilled hole 29, extending in the entire length of the releasing mechanism 18 and elongate holes 30 in the sides of the body 28, a trigger rod 31 being positioned inside the axially extending hole 30 in the releasing mechanism 18. The body 28 may for example be provided with two pairs of opposite facing openings, i.e. four elongate holes 30.

Referring to the FIGS. 1*a* and 1*b*, the releasing mechanism 18, and the valve 19 functions as follows. When installed, coupled to the liquid supply pipe (not shown), the inner closing sealing valve sealing surface 23 is pressed towards the corresponding inner valve sealing seat 20 by the trigger rod 31, forming a water tight seal able to resist the pressure acting in the supply pipe. The pressure acting on the sealed surface may for example be in the region 2.5-12 bar (FIG. 1*a*). When the trigger rod 31 breaks due to the existence of fire or fume, the liquid pressure acting on one side of the valve body 23, will force the valve 19 to move axially inside the large diameter hole 13, bringing the opposite surface of the valve body 23 against the lower valve seat 27, sealing the centrally arranged large diameter hole in the end wall, the stem 26 of the valve having entered the space of the release mechanism. When the upper sealing surface of the valve body 23 is moved away from its sealing contact with the upper valve seat 20, while a sealing effect is produced at the opposite end of the valve 10, low pressure water at a pressure in the region of 2.5-12 barwill be forced out trough the openings 14,16 and their apertures, the water being crushed into small droplet mist in the apertures, just before entering the surrounding area exposed to atmospheric pressure (FIG. 1*b*). The principle used according to the present invention for transforming the liquid into the mist will be described in further details below.

Figure 2:
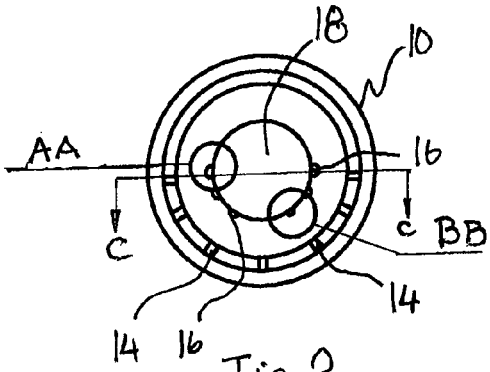
FIG. 2 shows an end view of a nozzle according to the invention, configured for installation in a wall.

FIG. 2 shows a front view of one embodiment of a nozzle 10 according to the invention, configured for installation in a wall (not shown) with its front, i.e. the front depicted in the Figure, facing towards the room or space to be covered by the nozzle 10.

The nozzle 10 is provided with a number of small radially arranged diameter holes 14, communicating with a large diameter hole 13, centrally arranged in the nozzle body 10. According to the embodiment shown in FIG. 2, the radially arranged holes 14 are only positioned on the lower half of the circular surface facing the room in which it is to be installed, arranged along the periphery of the nozzle 10 at its front. The radial holes 14 are configured with apertures formed in such way that the apertures will have an inclined or slanted surface which will cause crushing of the liquid when passing through the aperture, forming a misty spray in sideways direction when leaving the apertures and entering the room. The crushing mechanism functions in the following way: Portions of the fluid will tend to flow directly through the aperture while a portion will hit the inclined or slanted surface, such surface causing a change in direction of the flow so that the redirected flow hits the flow directed straight through the aperture, thus causing a crashing zone just upstream of the aperture where the pressure energy is utilized to produce the mist producing effect. Further, the drilled radial holes 14 and their apertures are configured in such way that the pressure drop occurs in the interface between the drilled holes 14 and their apertures, i.e. at the outlet of the holes 14. At this interface the pressure will drop from 2.5-12 bar to atmospheric pressure the static pressure being transformed to kinetic energy, forming a small droplet mist which is spread sideways out from the wall (not shown) on which the nozzle 10 is installed, wetting said wall surface.

As further indicated in FIG. 2, the nozzle 10 is also provided with apertures 16 in the front face of the nozzle 10, these apertures 16 also being positioned on the same half of the front surface as the radial holes 14. As indicated in FIG. 2, and more clearly seen in FIGS. 4 and 5, the apertures 14 on the front have different exposed cross sectional area. As further seen, the shape of the apertures of the holes 16 do not have a fully circular cross section, but are more or less semi-circular shaped, possibly with different cross section areas.

Figure 3:
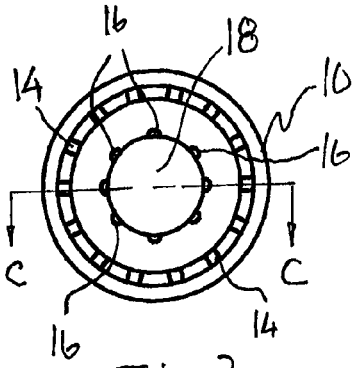
FIG. 3 shows an end view of a nozzle according to the invention according to a second embodiment, configured for installation in a ceiling.

FIG. 3 shows an end view of a nozzle 10 according to the invention, configured for installation in a ceiling. The only major differences between the nozzle 10 shown in FIG. 2 and the nozzle 10 shown in FIG. 3 are the number and positions of both the radial holes 15 and the axially arranged holes with apertures 16. Since the nozzle according to FIG. 3 is intended to be positioned in a ceiling, the radial holes 14 and the "centrally" arranged holes 16 are more or less evenly distributed along the entire periphery of the nozzle 10 or along a circle on the front face respectively.

Although the distance between two consecutive holes 14,16 are shown to be even, it should be noted that also such distance may vary both with respect to lateral and radial position without deviating from the scope of protection.

Figure 4:
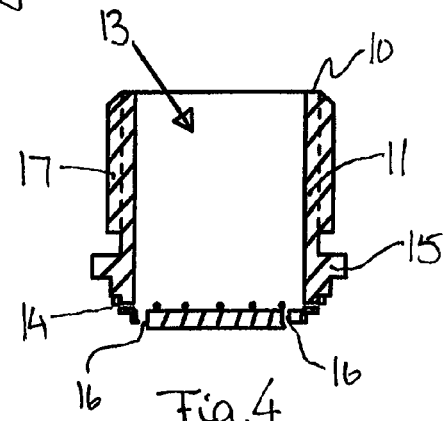
FIG. 4 shows a section through the nozzle seen along the lines C-C in FIG. 2 or FIG. 3.

FIG. 4 shows a section through the nozzle 10, seen along the lines C-C in FIG. 2 or FIG. 3. As shown, the cylindrical sleeve 11 of the nozzle 10 body is provided with a threaded portion 17, a hexagonal part 15; radially oriented holes 14 extending through the cylindrical sleeve 11 in the vicinity of the bottom 18 of the nozzle body 10. At the external side of the lower part of the sleeve 11 provided with the radial holes 14, a collar 33 is fixed just on the upper side of the holes 14, the surface of the collar 33 facing down towards the holes 14 has a slanted surface, so that parts of the fluid jet just prior to coming out of the holes 14, first hits the downwards and outwards slanted surface and then is hit by the remaining jet from the hole, creating an crashing effect producing a fine, minute droplet mist of the liquid flowing out through the apertures.

Figure 5:
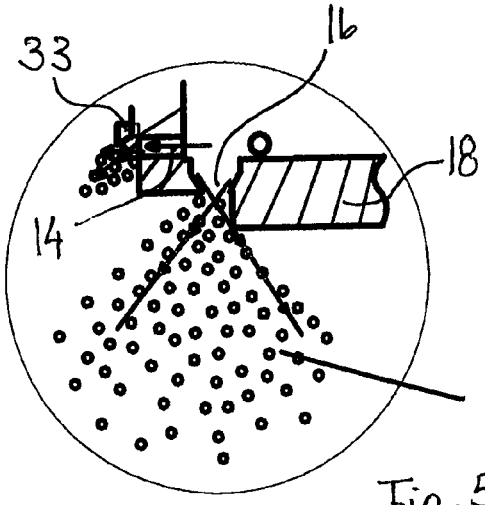
FIG. 5 shows in enlarged scale details of the nozzle openings indicated by the circle marked AA in FIG. 4.

FIG. 5 shows in enlarged scale details of the nozzle openings 14,16 shown in the circle marked AA in FIG. 4. As shown, the laterally arranged holes 14 are at their aperture provided with a liquid crushing means 33, the crushing means 33 being in the form of a flange fixed to the exterior of the nozzle body, the crushing means being configured in such way that an outwards and downwards sloped surface is established, said surface covering a portion of the external apertures of the holes 14 producing a flow restricted zone in the aperture , whereby part of the liquid jet is flowing through the aperture without hitting the sloped surface, while the remaining part of the liquid jet parts hits the sloped surface and is deflected, hitting the straight through flowing part, the impact between the two liquid jets causing the required mist consisting of very fine, minute liquid particles, directing such mist sideways with respect to the valve 10.

FIG. 5 also disclose one embodiment of the axially arranged hole 16 according to the present invention. According to the embodiment shown, the lower end of the axially aligned hole 16 is provided with a conical surface, whereby part of the liquid flow flowing along the periphery of the hole 16 through such lower end will be deflected towards the center of the hole and thus crush at the meeting point in the middle of the aperture of the hole 16, while the central portion of the flow will crush against the deflected liquid flow in the same region, thus creating the required mist of fine, minute droplets. According to this embodiment the direction of ejection of the sprayed mist will be a symmetrical spray perpendicular out from the aperture.

Figure 6:
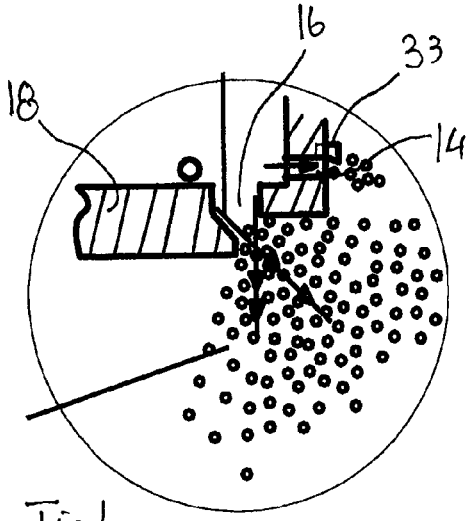
FIG. 6 shows in enlarged scale details of the nozzle openings marked BB in FIG. 5.

FIG. 6 shows in enlarged scale details of the nozzle openings marked BB in FIG. 4. The only major difference compared to the embodiment shown in FIG. 5 is the configuration of the axially aligned hole 16. According to the embodiment shown in FIG. 6, the hole 16 has a sector of the periphery being slanted or inclined, while the remaining part of the periphery sector is straight. With such configuration of the hole and the aperture, the direction of the mist emitted from the aperture will be directed outwards and also laterally from the aperture, since the fluid flow along the inclined or slanted surface will deflect from the main direction of the liquid flow, hitting the non-deflected flow approximately at the aperture of the hole 16.

Figure 7:
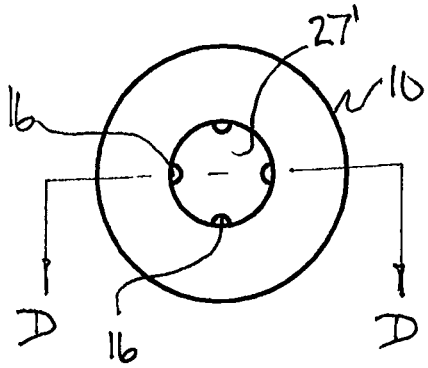
FIG. 7 shows another embodiment of the nozzle according to the invention, showing an end view of a point nozzle according to the present invention.

FIG. 7 shows an end view of a point nozzle 10 according to the present invention. According to this embodiment, the holes 16 with their apertures according to the invention, are centrally positioned, the nozzle being configured to direct the spray of mist more or less straight forward in a narrow sector. The embodiment shown in FIGS. 7-9 may not, as indicated, be equipped with radially directed holes 14.

FIG. 8 shows a section through the nozzle 10 shown in FIG. 7, seen along the line D-D. According to this embodiment the holes 16 may have a sector with a slanted surface while the remaining surface of the hole 16 may be straight. The holes are provided by drilling four axially oriented holes, partly into the end plate of the nozzle work piece, the depth of the four holes for example being slightly different, and/or their radial distance from the center for example being slightly different, and/or the end cone of the drill bit having different inclination and/or the diameter of the drill being different. Once the holes 16 are drilled a central part of the end plate is milled out, forming a central part 27' with a reduced thickness, thus forming an indent and creating the holes 16 with their various apertures.

FIG. 9 shows in enlarged scale details of the openings indicated by the circle AA in FIG. 8. A mist is created at the end of the apertures of the holes 16, caused in the same manner as specified above, the arrows showing typical main directions of the various sector flows.

FIGS. 10*a*-10*c* show three stages in the process of machining a work piece for producing a nozzle 10 according to the present invention, where FIG. 10*a* shows the initial stage where a central hole 13 is drilled or milled out in a work piece being in the form of a cylindrical massive rod, thus forming a hollow cylindrical body having for example a circular cross sectional shape and obtaining a closed bottom end or plate 27. FIG. 10*b* shows the stage where a number of radial holes 14 are drilled through the side wall, just above the bottom end or plate 27 and where any suitable number of axial holes 16 also are drilled partly into the bottom end or plate 27. As shown the drilling of the axial holes 17 is stopped prior to penetration through the bottom end or plate 27. FIG. 10*c* shows the final stage where part of the material of the bottom plate 27 on the external side of the bottom is machined out, thereby producing the apertures of the axially arranged holes 16 as further described above and disclosed in detail in FIGS. 2-9. As a further step, a circumferential ring 33 is also fixed to the exterior of the nozzle, just above the apertures of the radial holes, the lower surface of such ring 33 being flush with the upper boundary of the aperture of the holes 14. Said lower surface is inclined downwards and outwards, thus causing the require production of the mist as described above.

Although the nozzle is described in conjunction with fire-fighting, it should be noted that the nozzle also may be configured to introduce a mist mixture of minute and a bit larger droplets into a process in a process plant where appropriate.

The embodiment of the nozzle 10 shown in FIGS. 1*a* and 1*b* is based on the use of a loop shaped body containing the trigger rod. It should be noted, however that a conventional releasable lid, placed in front of the nozzle 10, may be used instead of the looped shaped body.

In FIGS. 1*a* and 1*b*, the nozzle is shown with a release mechanism 18 comprising a housing 28 and a trigger rod, the trigger rod 31 functioning as a temporary locking means until it is broken due to increased temperature in the surroundings. In the remaining Figures, said release mechanism 18 is omitted due to clarity reasons. It should be appreciated, however that the embodiments shown in FIGS. 2-10 also may be equipped with such release mechanism 18 attached to the nozzle 10.

Alternatively, the nozzles shown in the Figures may be configured without any such release mechanism 18 attached to the nozzle as such. In such case the extinguisher system may be triggered from a remote position, also opening a remote set of valves for supplying water at a pressure for example between 2.5-12 bar to the nozzle system. In such latter case the system functions as a deluge system where the nozzles functions as described above, i.e. produces a fine droplet mist.

It should also be appreciated that the nozzle according to the invention may be provided with any other suitable locking means attached to the nozzle, enabling release of the valve 19 for supply of water at a pressure so that water may be pulverized by the nozzle creating the required fine droplet mist.

The invention claimed is:

1. A fire-fighting extinguisher nozzle for providing a spray of fine droplet mist of liquid into a space, room or a cavity, comprising:

a housing;

a number of holes integral to the housing of the nozzle; and a number of openings in the exterior surface of the housing of the nozzle, each of the number of openings being at an end of a respective hole of the number of holes, the openings configured to communicate with a liquid source through the respective hole of the number of holes formed in a nozzle material, enabling liquid in the form of a spray to be directed at least partly in lateral direction and/or at least partly in a sector axially out from the nozzle, the nozzle being associated with a trigger mechanism, to initiate a spraying effect by allowing an extinguishing liquid to be sprayed out of the openings of the nozzle when heat or fumes are detected, wherein at least some of the number of holes are configured in such way that a mist of minute droplets is created by the respective opening of the number of openings, and are provided with a deflecting surface arranged inside the number of holes in the nozzle material, configured to cause formation of the mist spray of crushed liquid immediately inside the number of holes, the openings of the at least some of the number of holes having a crescent cross sectional shape.

2. Nozzle according to claim 1, wherein the deflecting surfaces are arranged inside the number of holes, the deflecting surfaces being formed by a tip of a drill bit, providing an internally arranged, slanted surface just inside the hole at its opening.

3. Nozzle according to claim 2, wherein the openings of at least some of the holes in the nozzle may be different in an exposed opening area, a lateral extent of the slanted surface being decisive for the size of the exposed opening area of the opening.

4. Nozzle according to claim 2, wherein the slanted surfaces are configured in such way that the opening is offset from the center of the hole, facing away from the center of the nozzle, allowing the spray of the mist created to be directed laterally away from the nozzle.

5. Nozzle according to claim 1, wherein some of the number of holes extend in the radial plane. allowing laterally orientated spraying, so as to provide spraying in all directions.

6. Nozzle according to claim 1, wherein the number of holes comprises a number of first holes and a number of second holes, the first holes of the number of holes are arranged with a center line placed closer to the center line of the nozzle than the second holes, wherein the openings of the second holes have different cross sectional areas than the openings of the first holes.

7. Nozzle according to claim 1, wherein the inner end of the holes are provided with a cone shape, an inclination of the cone end surface forms an angle, dependent upon a required inclination of an inclined surface and/or the size of the aperture, in order to vary the size of the aperture and the direction of the emitted spray of fine droplet mist.

8. Method for producing a spray of liquid forming a spray to be distributed into a space, room or a cavity, comprising:

producing the spray by allowing a liquid at a pressure to flow out through a number of openings in the exterior surface of a housing of a nozzle, the housing formed of a single metal piece, the openings being at an end of a respective hole of a number of holes extending through a wall of the nozzle, the openings communicating with a liquid source through the number of holes in the nozzle material, enabling the spray to be directed at least partly in a lateral direction and/or at least partly in a sector axially out from the nozzle, the nozzle provided with a trigger mechanism, initiating a spraying effect when subjected to detected heat or fumes, the formation of spray being initiated by the trigger mechanism, and initiating the flow of extinguishing liquid through the openings of the nozzle, wherein at least a part of the liquid flowing through the the number of holes is allowed to hit a deflecting surface provided inside the holes, causing a change in direction of flow immediately upstream of the openings, and further that at least another part of the liquid is allowed to flow straight through the number of holes, said latter flow being impacted by the deflected liquid, causing formation of a mist just upstream of an opening region of the number of holes, the openings of the at least some of the number of holes having a crescent cross sectional shape.

* * * * *